United States Patent [19]

Naumov et al.

[11] Patent Number: 4,604,175

[45] Date of Patent: Aug. 5, 1986

[54] PROCESS FOR REGENERATION OF IRON-COPPER CHLORIDE ETCHING SOLUTION

[76] Inventors: Jury I. Naumov, ulitsa Grubbe, 10, kv. 1; Dmitry K. Juzefovich, Moskovskoe shosse, 13, kv. 42; Valentina S. Epifanova, poselok Podnovie, 156, kv. 1; Vladimir I. Kucherenko, ulitsa Sverdlova, 93, kv. 77; Valery N. Flerov, ulitsa Kovalikhinskava, 30, kv. 80, all of Gorky; Anatoly M. Praporov, ulitsa Belovezhskava, 77, kv. 159, Moscow; Vladimir P. Shustov, ulitsa Grizhina, 23, korpus 5, kv. 67, Moscow; Alexel E. Sychev, prospekt Zagorskogo, 5, kv. 43, Moscow; Georgy V. Korolev, ulitsa Korolenko, 19a, kv. 9, Gorky; Evgeny P. Kotov, ulitsa Nedelina, 34, kv. 7; Yan N. Derevyanko, ulitsa 2 Pugachevskava, 4, korpus 2, kv. 136, both of Moscow, all of U.S.S.R.

[21] Appl. No.: 621,529

[22] Filed: Jun. 18, 1984

Related U.S. Application Data

[63] Continuation of Ser. No. 447,530, Dec. 7, 1982, abandoned.

[51] Int. Cl.[4] ..... C02F 1/46

[52] U.S. Cl. ..... 204/151; 204/149; 204/106; 204/112

[58] Field of Search ..... 204/149, 151, 130, 112, 204/107, 94, 52 R, 208, 106, 113

[56] References Cited

U.S. PATENT DOCUMENTS

| | | | |
|---|---|---|---|
| 3,502,551 | 3/1970 | Todt et al. | 204/52 R |
| 3,650,915 | 3/1972 | Quimby et al. | 204/52 R |
| 3,715,289 | 2/1973 | Cope, Jr. | 204/52 R |
| 3,832,291 | 8/1974 | Arcilesi | 204/52 R |
| 3,966,890 | 6/1976 | Parker et al. | 204/106 |
| 4,107,011 | 8/1978 | Kucherenko et al. | 204/149 |
| 4,436,601 | 3/1984 | Branchick et al. | 204/149 |

FOREIGN PATENT DOCUMENTS 1485605 9/1977 United Kingdom .

OTHER PUBLICATIONS

Grahm, K. A., *Electroplating Engineering Handbook,* 3rd Ed., Van Nostrand Reinhold Co., New York, p. 698, (1971).

Roberson, J. A. et al., *Engineering Fluid Mechanics,* 2nd Ed. Houghton Mifflin Co., Boston, p. 92, (1980).

Yaniv, D. et al., "Electrodeposition and Stripping at Graphite Cloth Electrodes", *Journal of Electroanalytical Chemistry,* 79, pp. 159–167, (1977).

*Primary Examiner*—John F. Niebling
*Assistant Examiner*—B. J. Boggs, Jr.
*Attorney, Agent, or Firm*—Robert E. Burns; Emmanuel J. Lobato; Bruce L. Adams

[57] ABSTRACT

A process for regeneration of an iron-copper chloride etching solution is disclosed which involves dividing the solution into at least two streams, one of which is supplied into a zone between the cathode and an anode made from a porous material permeable to elemental chlorine, at a rate ensuring laminary movement of the solution along the surface of the electrodes, while another stream is supplied into a zone after the anode at a rate ensuring turbulent movement of the solution along the anode surface. On the cathode the electrochemical reduction of ions of bivalent copper to metallic copper occurs and on the anode oxidation of ions of bivalent iron to ions of trivalent iron occurs, as well as chloride ions to elemental chlorine which diffuses through pores of the anode into the after-anode zone and oxidizes ions of bivalent iron. As a result, evolution of gaseous chlorine from the regenerating system is substantially avoided.

8 Claims, No Drawings

PROCESS FOR REGENERATION OF IRON-COPPER CHLORIDE ETCHING SOLUTION

This is a continuation of application Ser. No. 447,530, filed 12-7-82 now abandoned.

FIELD OF THE INVENTION

The present invention relates to electrolytic regeneration of spent iron-copper chloride etching solutions employed in the manufacture of printed circuit boards by the subtractive method.

BACKGROUND OF THE INVENTION

Copper etching is a complex oxidation-reduction process, wherein copper is converted from the metallic state into the ionic one and the oxidizing agent is reduced. The choice of an etching solution depends on many factors: type of the employed resistor coating applied to the circuit of printed boards, width of conductors and distance therebetween, possibility of repeated use of the etching solution, its production cost, and the like. For the manufacture of printed circuit boards by the subtractive method, acid solutions based on iron chloride and copper chloride are most extensively employed which have been hitherto employed only for a single time. This resulted in a high rate of consumption of chemicals for etching of printed circuit boards and was one of the principal sources of pollution of the environment.

Regeneration of spent etching solutions makes it possible to considerably reduce the rate of consumption of chemical agents for etching, bring down the amount and degree of contamination of waste water, improve the quality of printed circuit boards and increase the productivity of etching equipment. Regeneration can be effected by both chemical and electrochemical methods.

A method for chemical regeneration of spent copper chloride solutions by treatment thereof with hydrogen peroxide and hydrochloric acid, whereupon oxidation of ions of monovalent copper (the etching product in a copper-chloride solution) to the bivalent state occurs, thus resulting in a higher concentration of the oxidizing agent in solution. To maintain the required concentration of copper chloride in the etching solution, the latter is diluted with water, thus considerably increasing its volume. Excess etching solution is removed from the production cycle and subjected to further utilization.

This process features a great amount of waste water polluting the environment and is of a periodic character.

Also known are processes for electrochemical regeneration of spent chloride etching solutions, wherein metallic copper is recovered on a cathode in a powder-like form, while on an anode reduction of the oxidizing agent (iron chloride or copper chloride takes place). These processes are compatible with processes of etching of copper printed circuit boards in a single production cycle, which enables cutting down the rate of consumption of chemicals for etching, reducing the volume and degree of contamination of waste water, increasing the productivity of the etching equipment and a reduction of the cost of production of printed circuit boards.

A process for an electrochemical regeneration of iron-chloride solution (cf. U.S. Pat. No. 2,748,071), which is fed first into the cathodic space of a diaphragm electrolyzer is known in the art, wherein on a continuous steel band serving as a cathode, there occurs deposition of metallic copper as a powder and reduction of ions of trivalent iron unreacted in the course of etching. Then the solution is passed into the anodic space, wherein on graphite anodes ions of bivalent iron are oxidized to the trivalent state.

Performing the process under potentiostatic conditions makes it possible to eliminate the formation of gaseous chlorine on the anode, since the potential of graphite anodes corresponds to the potential of conversion of bivalent iron ions into trivalent iron ions. However, under these conditions the rate of deposition of copper on the cathode is insignificant thus lowering productivity of the unit for regeneration of iron-chloride solutions. The recovery of copper from the etching solutions as a powder contemplates the use of a device for its removal from the cathode, thus additionally complicating the regeneration equipment.

A process is known for regeneration of copper-chloride etching solutions (cf. U.S. Pat. No. 2,964,453), wherein such solution is regenerated in an electrolyzer formed from a steel tank lined with rubber and having 22 stationary anodes made from graphite and 54 rod-like copper cathodes secured on a hydraulic moving mechanism. Half of the cathodes are working members, while the other half are in a vessel for the removal of the copper deposit. The total surface area of the cathode is 12 square feet, while the surface area of the graphite anodes is six times that of the cathodes. The electrolysis is carried out under galvanostatic conditions at a current of 12,600 A. In this process metallic copper is recovered in powder-like form on copper rod-like cathodes while oxidation of ions of monovalent copper to the bivalent state occurs on the graphite anodes.

The use of high current densities and a partial self-regeneration of the copper-chloride etching solution due to oxidation of ions of monovalent copper with air oxygen results in that on the graphite anodes, in addition to oxidation of ions of monovalent copper, there occurs liberation of gaseous chlorine. The evolved chlorine is removed from the electrolyzer and delivered to scrubbers for absorption by an alkali solution.

This process is characterized by a high productivity relative to the recovered copper due to the use of high current densities on the electrodes; however, withdrawal of gaseous chlorine from the process cycle changes the etching solution composition and requires correction by using hydrochloric acid.

The liberation of gaseous chlorine on the anodes and formation of powdered copper complicates the equipment employed for the regeneration process.

A process is known for the electrochemical regeneration of spent copper-iron chloride etching solution (cf. USSR Inventor's Certificate No. 548051), which is carried out in a diaphragm electrolyzer under a current density ranging from 8 to 20 $A/dm^2$ on the electrodes. This solution is fed into the cathodic space of the electrolyzer, wherein on titanium cathodes recovery of powdered metallic copper occurs and ions of trivalent iron are reduced.

The recovery of metallic powder-like copper on the cathodes requires additional devices for periodic cleaning of the cathodes and washing of copper powder. During the operation of the regeneration unit water in the copper washing system becomes contaminated with the etching solution components and is an additional source of pollution of the environment.

From the cathodic space the copper-iron chloride etching solution is passed into the anodic space of the electrolyzer, wherein on graphite anodes processes of oxidation of ions of bivalent iron and recovery of gaseous chlorine occur. The gaseous chlorine liberated on the anodes is partly absorbed in the electrolyzer due to chemical interaction with ions of bivalent iron according to the scheme:

$$2Fe^{2+}+Cl_2 \rightarrow 2Fe^{3+}+2Cl^-$$

The unreacted chlorine from the electrolyzer is passed into a vessel with the etching solution, wherein it is fully absorbed due to the reaction.

For a better absorption of gaseous chlorine in the electrolyzer, the etching solution is passed into the anodic space in counter-current relative to the liberated chlorine at a rate at least 1.5 times higher than that of the stream in the cathodic space. The provision of different rates of stream in the cathodic and anodic spaces of the electrolyzer requires the use of a partitioning diaphragm which causes an increase of the voltage impressed to the electrolyzer and a higher rate of consumption of electric power for the recovery of copper.

This process has a high productivity relative to the recovered copper and a constant composition of the etching solution due to recycling of chlorine evolved on the anode. However, evolution of gaseous chlorine on the anode requires thorough sealing of the entire system, presence of transfer conduits for chlorine and special absorbents, which complicate the process equipment and do not prevent release of chlorine into the atmosphere in case the system becomes untight.

Regeneration of the spent etching solution is effected at current densities of up to 20 A/dm$^2$, and further intensification of the process is impossible due to a sharp increase of the amount of gaseous chlorine evolved on the anode, which substantially hinders its absorption.

SUMMARY OF THE INVENTION

It is an object of the present invention to provide a process for regeneration of iron-copper chloride etching solution, which has a high productivity.

It is another object of the present invention to provide a process for regeneration of iron-copper chloride etching solution, which makes it possible to simplify the process equipment and enables a reliable protection of the environment from pollution with waste water and gaseous chlorine, due to elimination of evolution of gaseous chlorine on the anode and production of metallic copper on the cathode in the form of a compact deposit.

The object of the present invention is accomplished by the provision of a process for regeneration of an iron-copper chloride etching solution by way of electrochemical reduction of ions of bivalent copper to metallic copper on the cathode and oxidation of ions of bivalent iron to ions of trivalent iron and chlorine ions on the anode, wherein, according to the present invention, use is made of an anode from a porous material permeable for elemental chlorine and the etching solution is divided into at least two streams one of which is fed into the zone between the cathode and anode at a rate ensuring a laminary movement of the solution along the electrode surface, while another stream is fed into the zone after the anode at a rate ensuring a turbulent movement of the solution along its surface; in doing so, on the anode surface elemental chlorine forms which diffuses through the pores of the anode into the after-anode zone and oxidizes ions of bivalent iron.

Carrying out regeneration under these conditions with the use of the above-described anode structure makes it possible to increase productivity and simplify the process equipment due to elimination of the formation of gaseous chlorine on the anode.

For the formation of metallic copper on the cathode in the form of a compact deposit, it is desirable to and, to the iron-copper chloride etching solution to be regenerated, a still residue resulting from the interaction of hydrocyanic acid and ethylene oxide, as well as lignosulphonate; on the whole the above-specified solution should contain the components in the following proportions, g/l:

| | |
|---|---|
| cupric chloride | 150 to 350 |
| ferric chloride | 20 to 200 |
| ferrous chloride | 10 to 50 |
| potassium chloride | 100 to 250 |
| hydrochloric acid | 20 to 60 |
| still residue after the interaction of hydrocyanic acid and ethylene oxide | 2 to 6 |
| lignosulphonate | 1 to 3. |

To improve the conditions of diffusion of elemental chlorine through the anode pores, it is advisable to use an anode from graphitized felt.

To intensify the process and improve its productivity, it is desirable that the regeneration be effected at a current density on the electrodes of from 10 to 40 A/dm$^2$.

DETAILED DESCRIPTION OF THE INVENTION

The process according to the present invention is performed in the following manner.

An iron-copper chloride etching solution from a device for etching of copper printed circuit boards is divided into at least two streams which are simultaneously fed into an electrolyzer. One of the streams is passed into a zone between the anode and cathode at a rate ensuring a laminary movement of the solution along the surface of the electrodes, while another stream is fed into an after-anode zone at a rate ensuring a turbulent movement of the solution along its surface. On the titanium cathode the following reactions proceed:

$$Cu^{2+}+\bar{e} \rightarrow Cu^+$$

$$Cu^+ + \bar{e} \rightarrow Cu^\circ$$

$$Fe^{3+}+\bar{e} \rightarrow Fe^{2+}$$

On the anode made from a porous material permeable for elemental chlorine, e.g. from graphitized felt, there take place processes of oxidation of ions of bivalent iron and chlorine ions:

$$Fe^{2+} - \bar{e} \rightarrow Fe^{3+}$$

$$Cl^- - \bar{e} \rightarrow Cl \text{ elemental}$$

The resulting elemental chlorine can oxidize ions of bivalent iron to a trivalent state according to the reaction:

$$\text{elemental } Cl + Fe^{2+} \rightarrow Fe^{3+} + Cl^-$$

with conversion into the ionic state and into gaseous chlorine as well.

It is known that the rate of oxidation of ions of bivalent iron according to the above reaction is determined by the concentration of its ions in solution. To ensure absorption of elemental chlorine by the etching solution, its flow rate in the zone between the electrodes is increased, which results in impaired conditions for the deposition of metallic copper on the cathode. Liberation of gaseous chlorine on the anode can be inhibited by the provision of at least two streams of the iron-copper chloride etching solution, fed into the electrolyzer at different flow rates and by the use of a porous anode permeable for elemental chlorine.

Under these conditions, namely at different rates of supply of ions of bivalent iron to the anode surface in the zone between the electrodes and in the zone after the anode, elemental chlorine diffuses through the anode and reacts with the etching solution in the after-anode zone. In this case there is no evolution of elemental chlorine on the anode at the cathode's side.

Carrying out regeneration by this process does not require the use of a partitioning diaphragm in the electrolyzer, hermetization of the latter and use of transportation conduits for chlorine and special absorbents due to the absence of liberation of gaseous chlorine on the anodes which results in simplified process equipment.

The use of an anode from a porous material permeable for elemental chlorine, for example from graphitized felt, makes it possible to carry out regeneration at a current density on the electrodes within the range of from 10 to 40 A/dm$^2$ without liberation of gaseous chlorine. In regeneration of the etching solution at a current density below 10 A/dm$^2$ there is observed a reduced current yield of metallic copper, while at a current density above 40 A/dm$^2$ it is possible that copper is formed on the cathode as a powder and gaseous chlorine is liberated on the anode. To obtain the cathodic copper in the form of compact deposit, it is advisable to use for regeneration an iron-copper chloride etching solution of the following initial composition, g/l:

| | |
|---|---|
| cupric chloride | 150 to 350 |
| ferric chloride | 20 to 200 |
| ferrous chloride | 10 to 50 |
| potassium chloride | 100 to 250 |
| hydrochloric acid | 20 to 60 |
| still residue after the interaction of hydrocyanic acid and ethylene oxide | 2 to 6 |
| lignosulphonate | 1 to 3. |

The upper limit of the content of cupric chloride, ferric chloride and potassium chloride are determined by their solubility in water, the lower limit—by the requirements of high rates of etching of printed circuit boards in this solution.

The content of hydrochloric acid below 20 g/l results in the formation, as a result of hydrolysis, of solid particles of salts of copper and iron in the solution, which can be the reason for mechanical damage to the resist coating of the circuit of the printed circuit boards. Increasing the concentration of hydrochloric acid above 60 g/l is limited by its volatility from the solution and pollution of the environment.

The presence of the first four components in the above-specified concentrations in the solution is due to the parameters of the etching process, the speed and quality of the resulting printed circuit boards. At the same time, the presence of the two last-mentioned components in the solution is dictated by the necessity of producing a compact deposit of copper on the cathode, though these components affect the etching process.

The production of the cathodic copper in the form of a monolithic deposit makes it possible to avoid the use of units for cleaning the cathodes from powder-like copper, as well as to eliminate the system of washing copper powder from the process equipment, thus considerably simplifying the process scheme, and avoiding the formation of waste water contaminated with the solution components after regeneration.

Copper in the form of a compact deposit recovered on the cathodes can be further employed as anodes in electroplating engineering.

One of the solution components contributing to the production of a compact copper deposit is the still residue resulting from the interaction of hydrocyanic acid and ethylene oxide. It contains:

water;
dihydrio glycols and polyglycols;
high-molecular alcohols;
polyethylene hydrates;
aminoacids and salts thereof;
nitrogen-containing polyethyleneoxides;
$\beta,\beta'$—dicyanodiethyl ether.

This product is a viscous liquid of a dark-brown color with a specific gravity of 1.197 g/cm$^3$ and is a complex of organic compounds with its exact composition and chemical formula so far unknown. In solutions of electrolytes it manifests itself as a cation-active compound with a high wetting effect.

The second component of the solution ensuring the production of compact copper deposits on the cathode is a by-product of pulp-and-paper production and is a mixture of calcium-sodium (ammonium) salts of lignosulphonic acids which are freed, as a result of biochemical treatment, from organic substances such as sugars and organic acids.

This substance is a thick dark-brown liquid which is a cation-active compound, its exact composition being still unknown.

The lower limit of the content of the introduced additives is restricted by the necessity of producing compact cathode residues of copper at a current density within the range of from 10 to 40 A/dm$^2$; the upper limit is restricted by the necessity of ensuring optimal etching speed and quality of the produced printed circuit boards.

Owing to a high rate of recovery of metallic copper from the iron-copper chloride etching solution, the process of regeneration is combined with the process of etching into a single process. Combination of these two processes makes it possible to maintain constant composition of the etching solution during operation and ensures automatic functioning of the equipment, as well as eliminates waste water disposal.

For the purpose of comparison with the process according to the present invention, the process for regeneration of an iron-copper chloride etching solution according to USSR Inventor's Certificate No. 548051 was carried out. The characteristics of both processes are given hereinbelow (Table 1).

TABLE 1

| No. | Regeneration process 1 | Solution composition, g/l 2 | Solution volume, l. 3 | Dissolved copper amount, kg 4 | Rate of etching μm/min 5 | Current density A/dm² 6 |
|---|---|---|---|---|---|---|
| 1. | Process of USSR Inventor's Certificate No. 548051 | $CuCl_2$ 135<br>$FeCl_3$ 162<br>$FeCl_2$ 10<br>KCl 150<br>HCl 40 | 50 | 0.3 | 35 | 15 |
| 2. | Process of the present invention | $CuCl_2$ 135<br>$FeCl_3$ 162<br>$FeCl_2$ 10<br>KCl 150<br>HCl 40<br>Still residue after the interaction of hydrocyanic acid and ethylene oxide 6<br>lignosulphonate 3 | 50 | 0.3 | 33 | 30 |

| No. | Cathode area, dm² 7 | Voltage, V 8 | Copper current yield, % 9 | Chlorine current yield, % 10 | Temperature °C. 11 | Amount of recovered copper, kg 12 | Regeneration time, hrs 13 | Power consumption kW · hr 14 |
|---|---|---|---|---|---|---|---|---|
| 1. | 40 | 6 | 53 | 10 | 40 | 0.3 | 0.77 | 2.76 |
| 2. | 40 | 4.5 | 60 | — | 40 | 0.3 | 0.31 | 1.75 |

The results in the Table show that the process according to the present invention eliminates evolution of gaseous chlorine on the anodes, reduces the time of regeneration of the solution, decreases the rate of electric power consumption for the recovery of copper and makes it possible to simplify the process equipment.

For a better understanding of the present invention, some specific examples illustrating the process of regeneration or iron-copper chloride etching solution are given hereinbelow.

EXAMPLE 1

Fifty liters of an etching solution having the following composition, g/l:

| | |
|---|---|
| cupric chloride | 150 |
| ferric chloride | 20 |
| ferrous chloride | 20 |
| potassium chloride | 250 |
| hydrochloric acid | 60 |
| still residue after the interaction of hydrocyanic acid and ethylene oxide | 2 |
| lignosulphonate | 1 |

from a device for etching of printed circuit boards are separated into two streams and supplied into an electrolyzer at the temperature of 20° C. One of the streams is fed into a zone between the cathode and anode at a rate ensuring laminary movement of this solution along the surface of the electrodes (Re=200). The second stream is fed into the zone after the anode at a rate ensuring turbulent movement of the solution along its surface (Re=10,000). At the cathode at the current density of 20 A/dm² there occurs evolution of metallic copper as a monolithic deposit and reduction of trivalent iron to the bivalent iron state. The cathodic current yield for copper is 70%. On the anode made from graphitized felt at the current density of 20 A/dm² oxidation of ions of bivalent iron to the trivalent state and occurs and chlorine ions are oxidized to elemental chlorine.

Elemental chlorine diffuses through the anode into the after-anode zone and oxidizes there ions of bivalent iron of the etching solution. No evolution of gaseous chlorine is observed, though the anode potential is 1.6 V. The effluent streams from the electrolyzer are combined and delivered into the apparatus for etching of printed circuit boards. After 31 minutes of electrolystis the etching solution matches the initial one both in the composition thereof and the rate of copper etching. The speed of etching of printed circuit boards is in both cases 20 μm/min.

EXAMPLE 2

Fifty liters of an etching solution having the following composition, g/l

| | |
|---|---|
| cupric chloride | 135 |
| ferric chloride | 162 |
| ferrous chloride | 30 |
| potassium chloride | 150 |
| hydrochloric acid | 40 |
| still residue after the interaction of hydrocyanic acid and ethylene oxide | 6 |
| lignosulphonate | 3 |

from the apparatus for etching of printed circuit boards are divided into two streams which are supplied into the electrolyzer at the temperature of 40° C. One of the streams is fed into the zone between the cathode and anode at a rate ensuring a laminary movement of the solution along the surface of the electrodes (Re=200). The second stream is fed into the after-anode zone at a rate ensuring a turbulent movement of the solution along the anode surface (Re=10,000). On the cathode at the current density of 20 A/dm² there occurs evolution of copper as a monolithic deposit and reduction of trivalent iron ions to the bivalent state. The cathodic current yield for copper is 60%. On the anode made from a graphitized felt at the current density of 20 A/dm$^2$ there occurs oxidation of ions of bivalent iron to the trivalent state and chlorine ions are oxidized to elemental chlorine. Elemental chlorine diffuses through the anode into the after-anode zone and there it oxidizes ions of bivalent iron of the etching solution. No evolutions of gaseous chlorine is observed, though the anode potential is 1.6 V. The effluent streams from the electrolyzer are combined and delivered into the apparatus for etching of printed circuit boards. After 37 minutes of electrolysis the etching solution matches the initial one in both the composition thereof and the rate of copper etching. The speed of etching of copper is in both cases 33 μm/min.

EXAMPLE 3

Fifty liters of an etching solution having a composition similar to that described in Example 2 hereinabove from an apparatus for etching of printed circuit boards are divided into two streams and supplied into an electrolyzer at the temperature of 40° C. One of the streams is fed into a zone between the cathode and anode at a rate ensuring laminary movement of the solution along the surface of the electrodes (Re=500). The second stream is supplied into the zone after the anode at a rate ensuring turbulent movement of the solution along the anode surface (Re=20,000). On the cathode at the current density of 40 A/dm$^2$ there occurs recovery of metallic copper as a compact residue and reduction of ions of trivalent iron to the bivalent state. The cathodic current yield of copper is 55%. On the anode made from a graphitized felt there occurs, at the current density of 40 A/dm$^2$, oxidation of ions of bivalent iron to the trivalent state and chlorine ions to elemental chlorine. Elemental chlorine diffuses through the anode into the after-anode zone and there it oxidizes ions of bivalent iron of the etching solution. No evolution of gaseous chlorine is observed, though the anode potential is 2.0 V. The outgoing streams from the electrolyzer are combined and delivered into the apparatus for etching copper printed circuit boards. After 21 minutes of electrolysis the etching solution matches the initial one in both the composition thereof and the rate of copper etching. The speed or rate of etching of copper in both cases is 33 μm/min.

EXAMPLE 4

Fifty liters of an etching solution having a composition similar to that described in Example 1 from an apparatus for etching copper printed circuit boards is divided into two streams which are supplied into an electrolyzer at the temperature of 20° C. One of the streams is supplied into a zone between the cathode and anode at a rate ensuring laminary movement of the solution along the surface of the electrodes (Re=200). The second stream is fed into the zone after the anode at a rate ensuring turbulent movement of the solution along the anode surface (Re=20,000). On the cathode at the current density of 10 A/dm$^2$ recovery of metallic copper in the form of a compact deposit and reduction of ions of trivalent iron to the bivalent state occur. The cathode current yield of copper is 68%.

On the anode made from porous graphite at the current density of 10 A/dm$^2$ oxidation of ions of bivalent iron to the trivalent state and chlorine ions to elemental chlorine occur.

Elemental chlorine diffuses through the anode into the zone after the anode and there it oxidizes ions of bivalent iron of the etching solution. No evolution of gaseous chlorine is observed, though the anode potential is 1.4 V.

The outgoing streams from the electrolyzer are combined and delivered into the apparatus for etching printed circuit boards. After 50 minutes of electrolysis the etching solution matches the initial one in both its composition and the rate of copper etching. The speed of copper etching in both cases is 20 μm/min.

EXAMPLE 5

Fifty liters of an etching solution having the following composition, g/l:

| | |
|---|---|
| cupric chloride | 150 |
| ferric chloride | 200 |
| ferrous chloride | 50 |
| potassium chloride | 100 |
| hydrochloric acid | 60 |
| still residue after the interaction of hydrocyanic acid and ethylene oxide | 4 |
| lignosulphonate | 2 |

from an apparatus for etching printed circuit boards are separated into two streams and supplied into the electrolyzer at the temperature of 30° C. One of the streams is fed into a zone between the cathode and the anode at a rate ensuring laminary movement of this solution along the surface of the electrodes (Re=800). The second stream is fed into a zone after the anode at a rate ensuring turbulent movement of this solution along the anode surface (Re=30,000).

On the cathode at the current density of 15 A/dm$^2$ there occurs recovery of metallic copper in the form of a compact deposit and reduction of ions of trivalent iron to the bivalent state. The cathode current yield of copper is 50%. On the anode made from a porous graphite oxidation of ions of bivalent iron to the trevalent state and chlorine ions are oxidized to elemental chlorine occur.

Elemental chlorine is diffused through the anode into the after-anode zone and there it oxidizes ions of bivalent iron of the etching solution. No evolution of gaseous chlorine is detected, though the anode potential is equal to 1.5 V. The outgoing from the electrolyzer are combined and delivered into the apparatus for etching printed circuit boards. After 1 hour 20 minutes of the electrolysis the etching solution matches the initial one in both its composition and the rate of etching of copper. The speed of etching of copper in both cases is 30 μm/min.

EXAMPLE 6

Fifty liters of an etching solution having the following composition, g/l:

| | |
|---|---|
| cupric chloride | 150 |
| ferric chloride | 200 |
| ferrous chloride | 10 |
| potassium chloride | 100 |
| hydrochloric acid | 50 |
| still residue after the interaction of hydrocyanic acid and ethylene oxide | 4 |

-continued

| | |
|---|---|
| cyanic acid and ethylene oxide | 4 |
| lignosulphonate | 2 |

from an apparatus for etching printed circuit boards are divided into three streams which are fed into the electrolyzer at the temperature of 20° C. The electrolyzer has three zones: zone I—between the cathode and anode; zone II—between two anodes; zone III—between the anode and cathode. The first two streams are fed into the interelectrode zones (I) and (III) at a rate ensuring laminary movement of the above-mentioned solution along the surface of the electrodes (Re=1,500). The third stream is fed into zone (II) between two anodes at a rate ensuring turbulent movement of this solution along their surface (Re=50,000). On the cathode at the current density of 20 A/dm$^2$ deposition of metallic copper in the form of a compact residue and reduction of ions of trivalent iron into the bivalent state occur. The cathodic current yield of copper is 40%. On the anode made from a porour graphite there occurs oxidation of ions of bivalent iron to the trivalent state and chlorine ions—to elemental chlorine. Elemental chlorine diffuses through the anode into the after-anode zone i.e. into zone II and there it oxidizes ions of bivalent iron of the etching solution supplied into this zone.

No evolution of gaseous chlorine is observed, though the anode potential is equal to 1.6 V. The outgoing streams from the electrolyzer are combined and delivered into the apparatus for etching printed circuit boards. After 10 minutes of the electrolysis the etching solution matches the starting one in both the composition thereof and the rate of etching of copper. The speed of copper etching in both cases is 30 μm/min.

What is claimed is:

1. A process for regeneration of an iron-copper chloride etching solution in an electrolyzer having electrodes comprising:

initially dividing said iron-copper chloride etching solution into at least two separate streams;

supplying the first stream into the electrolyzer in a first zone between a cathode and an anode, said anode being made of a porous material having pores permeable to elemental chlorine, and said first stream being introduced at a rate ensuring laminary flow of said iron-copper chloride etching solution along the surface of the electrodes;

supplying the second stream into said electrolyzer in a second zone between the anode and the shell of the electrolyzer at a rate ensuring turbulent flow of said iron-copper chloride etching solution along the surface of the anode;

electrochemically reducing ions of bivalent copper to metallic copper on the cathode;

electrochemically oxidizing ions of bivalent iron to ions of trivalent iron on the anode, whereby elemental chlorine is formed which diffuses through pores of the anode into the second zone and oxidizes ions of bivalent iron in said second zone.

2. The process as claimed in claim 1, wherein said regeneration is effected with a solution containing, as additives, lignosulfonate and a still residue obtained as a result of the interaction of hydrocyanic acid and ethylene oxide.

3. The process as claimed in claim 1, wherein said iron-copper chloride etching solution being regenerated has the following composition, g/l:

| | |
|---|---|
| cupric chloride | 150 to 350 |
| ferric chloride | 20 to 200 |
| ferrous chloride | 10 to 50 |
| potassium chloride | 100 to 250 |
| hydrochloric acid | 20 to 60 |
| still residue [after] obtained as a result of the interaction of hydro- and ethylene oxide | 2 to 6 |
| [lignosulphonate] lignosulfonate | 1 to 3. |

4. The process as claimed in claim 1, wherein the porous anode is made of graphitized felt.

5. The process as claimed in claim 1, wherein regeneration of said iron-copper chloride etching solution is effected at a current density on the electrodes ranging from 10 to 40 A/dm$^2$.

6. The process of claim 1 wherein substantially all elemental chlorine is used for oxidation during the electrolysis and the evolution of gaseous chlorine into the atmosphere during electrolysis is avoided.

7. The process as claimed in claim 1 wherein the second stream which is supplied to the electrolyzer at a rate ensuring turbulent flow moves about 33 to 100 times faster than the first stream which is supplied to the electrolyzer at a rate ensuring laminary flow.

8. The process as claimed in claim 1 wherein said regeneration is effected with an etching solution containing as additives, a still residue obtained as a result of the interaction of hydrocyanic acid and ethylene oxide, and lignosulfonate and wherein the stream of turbulent flow moves about 33 to 100 times faster than the stream of laminary flow.

* * * * *